US011821632B2

(12) United States Patent
Yu et al.

(10) Patent No.: US 11,821,632 B2
(45) Date of Patent: Nov. 21, 2023

(54) CONTROL PANEL MECHANISM OF A RANGE HOOD

(71) Applicant: Ningbo Fotile Kitchen Ware Co., Ltd., Ningbo (CN)

(72) Inventors: Ting Yu, Ningbo (CN); Zhineng Xu, Ningbo (CN)

(73) Assignee: Ningbo Fotile Kitchen Ware Co., Ltd., Ningbo (CN)

( * ) Notice: Subject to any disclaimer, the term of this patent is extended or adjusted under 35 U.S.C. 154(b) by 594 days.

(21) Appl. No.: 17/250,054

(22) PCT Filed: Mar. 13, 2019

(86) PCT No.: PCT/CN2019/077986

§ 371 (c)(1),
(2) Date: Nov. 13, 2020

(87) PCT Pub. No.: WO2019/223403

PCT Pub. Date: Nov. 28, 2019

(65) Prior Publication Data

US 2021/0215349 A1 Jul. 15, 2021

(30) Foreign Application Priority Data

May 24, 2018 (CN) ..... 201820785881.6

(51) Int. Cl.
*F24C 15/20* (2006.01)

(52) U.S. Cl.
CPC ..... *F24C 15/2021* (2013.01); *F24C 15/2071* (2013.01)

(58) Field of Classification Search
CPC ..... F24C 15/2021; F24C 15/2071
USPC ..... 126/299 R; 454/49–67
See application file for complete search history.

(56) References Cited

U.S. PATENT DOCUMENTS 9,523,507 B2 * 12/2016 Bruin-Slot ..... F24F 13/0254
11,506,400 B2 * 11/2022 Xu ..... F24C 15/007
2014/0352151 A1 * 12/2014 Bruin-Slot ..... A47B 77/08 29/897.3
2017/0059180 A1 * 3/2017 Bruin-Slot ..... F24C 15/2071

OTHER PUBLICATIONS

CN-206398798-U translation, 2017.*
CN-201003805-Y translation, 2008.*
WO-2010023073-A2 translation, 2010.*

* cited by examiner

*Primary Examiner* — Ko-Wei Lin
(74) *Attorney, Agent, or Firm* — Wang Law Firm, Inc.

(57) ABSTRACT

The present invention discloses a control panel mechanism of a range hood. The control panel mechanism comprises a glass panel (1) and a control component (2), a plurality of mounting plates (4) each having two ends are disposed on the back of the glass panel (1), one end of each mounting plate (4) is connected to the control component (2) by a plurality of first fasteners (6); the mounting plates (4) are detachably connected to a front side plate (31) of a housing (2) of the range hood, and the mounting plates (4) is attached to a top plate (32) of the housing (2) by a second fastener (7). So that it is very convenient to assemble and disassemble the control component.

6 Claims, 10 Drawing Sheets

CONTROL PANEL MECHANISM OF A RANGE HOOD

TECHNICAL FIELD OF THE INVENTION

The present invention relates to the technical field of range hoods, and in particular to a control panel mechanism of a range hood.

BACKGROUND OF THE INVENTION

A control panel mechanism of a range hood generally consists of a glass panel, a control component, etc. For example, a range hood disclosed in a Chinese Patent No. CN102393035A (Patent No. 201110272285.0) comprises a flue, a collecting hood, an internal fume extraction mechanism and a control panel. For another example, a range hood disclosed in a Chinese Patent No. CN105299721A (Patent No. 201510678855.4) comprises a flared fume hood body and a machine body. A fume outlet of the fume hood body is connected to a fume inlet of the machine body, a turbine and a motor driving turbine blades to rotate are provided in the machine body, a tapered oil filter assembly extending out of an opening of the fume hood body is provided at the bottom of the hood body, and a control panel is provided on one side of the hood body.

The control component of the range hood is a vulnerable part. However, in existing range hoods, the control component is generally fixed directly to the glass panel, making it inconvenient to repair and replace the control component.

SUMMARY OF THE INVENTION

It is an object of the present invention to provide a control panel mechanism of a range hood, in which the control component is easily assembled and disassembled.

For achieving the above object, the control panel mechanism of a range hood comprises: a glass panel and a control component; wherein, a plurality of mounting plates each having two ends are disposed on the back of the glass panel, one end of each mounting plate is connected to the control component by a plurality of first fasteners; the mounting plates are detachably connected to a front side plate of a housing of the range hood, and the mounting plates is attached to a top plate of the housing by a second fastener.

Preferably, each mounting plate has at least one inserting piece extending backward relative to the glass panel, and the front side plate has a plurality of inserting hole for receiving the inserting piece; the at least one inserting piece has a first mounting hole, and the top plate has a second mounting hole corresponding to the first mounting hole, and the second fastener passing through the first mounting hole and the second mounting hole attaching the inserting piece to the top plate. The mounting plate can be detachably connected to the front side plate of the housing by inserting the inserting pieces into the inserting holes, and fixed to the housing by the first mounting hole formed on the inserting piece.

Preferably, a free end of each inserting piece extends towards the same direction. During its assembly, the control panel mechanism is first dislocated in close proximity to the front side plates of the housing so as to insert the inserting piece into the corresponding inserting hole, and then returned to a normal position so as to fasten the bent portion of each inserting piece on one side of the inserting hole, thereby limiting the inserting piece in the corresponding inserting hole, so that a relatively stable and detachable connection can be realized between the control panel mechanism and the housing.

Preferably, the second mounting hole is designed with an annular step below the surface of the top plate. With such design, the head of the second fastener is located inside the second mounting hole, so that the mounting position of the second fastener is not directly visible, which can make the appearance of the range hood elegant.

Preferably, two mounting plates are disposed on both left and right sides of the glass panel, and each mounting plate matches with the glass panel. In this way, the control component can be firmly mounted on the glass panel, and the control panel mechanism can also be firmly connected to the housing.

Preferably, a plurality of filler strips surrounding the control component and the mounting plate, and abutting against the front surface of the front side plate of the housing, are disposed on the back of the glass panel along the circumferential direction. It can avoid the damage to the glass panel caused by hard contact with the housing during transportation or operating vibration.

Compared with the prior art, the present invention has the following advantages. The mounting plates are disposed on the back of the glass panel, with one end thereof being connected to the control component by a plurality of first fasteners, and each mounting plate is detachably connected to the front side plate of the housing of the range hood and fixed to the top plate of the housing by a second fastener. When it is necessary to repair or replace the control component, the control component can be removed from the glass panel by unscrewing the first fasteners after the control panel mechanism is removed from the housing of the range hood by unscrewing the second fastener, so that it is very convenient to assemble and disassemble the control component.

DETAILED DESCRIPTION OF THE INVENTION

The present invention will be further described below in detail by embodiments with reference to the accompanying drawings.

Figure 1:
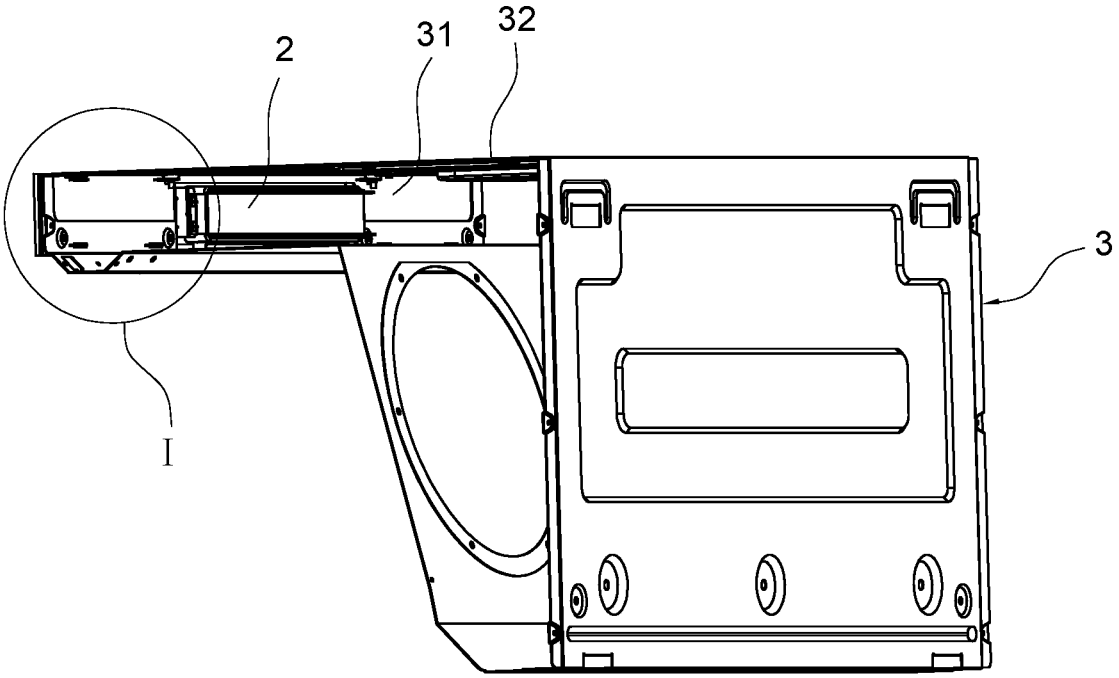
FIG. 1 is a partial perspective view of a range hood with a control panel mechanism according to an embodiment of the present invention.
Figure 2:
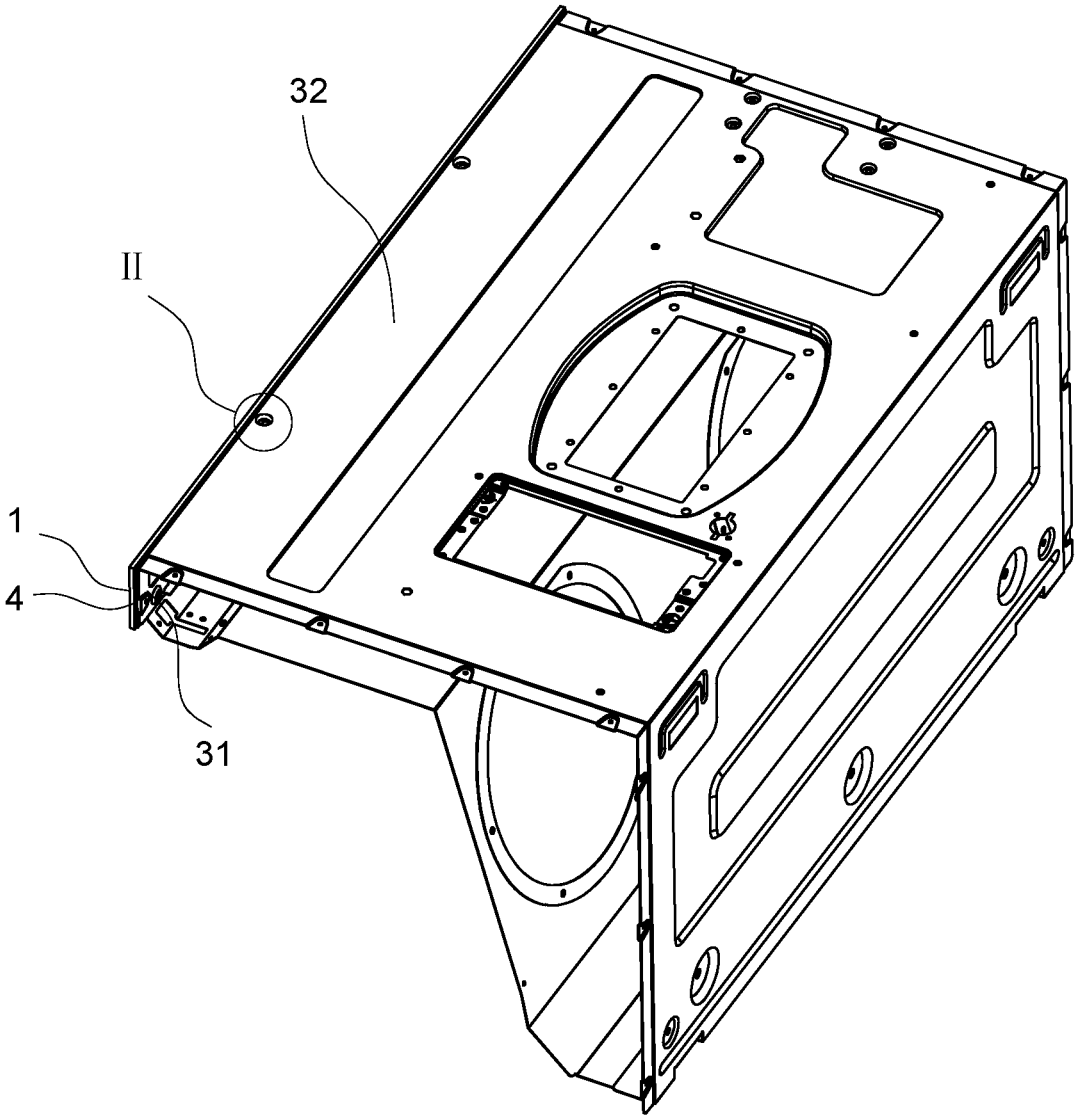
FIG. 2 is another perspective view of FIG. 1.
Figure 3:
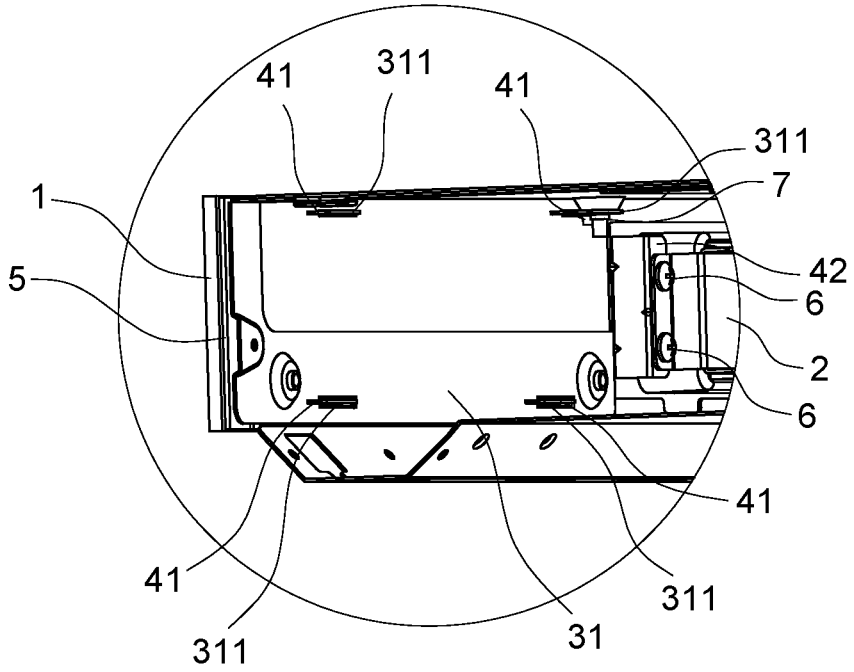
FIG. 3 is an enlarged view of a Part-I in FIG. 1.
Figure 4:
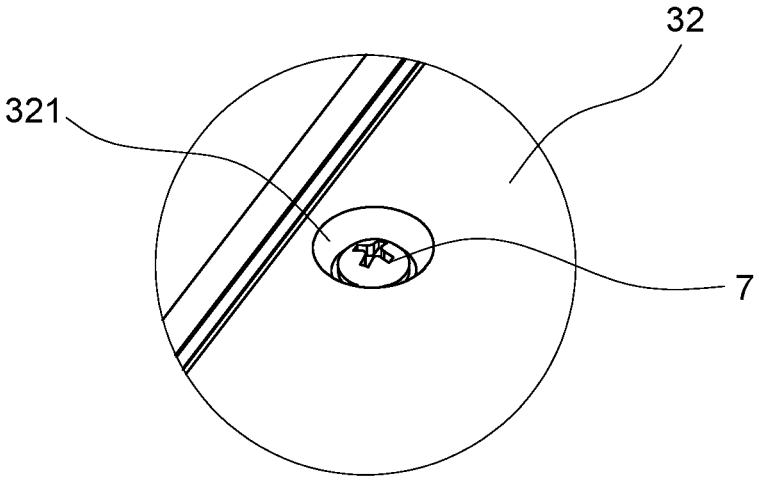
FIG. 4 is an enlarged view of a Part-II in FIG. 2.
Figure 5:
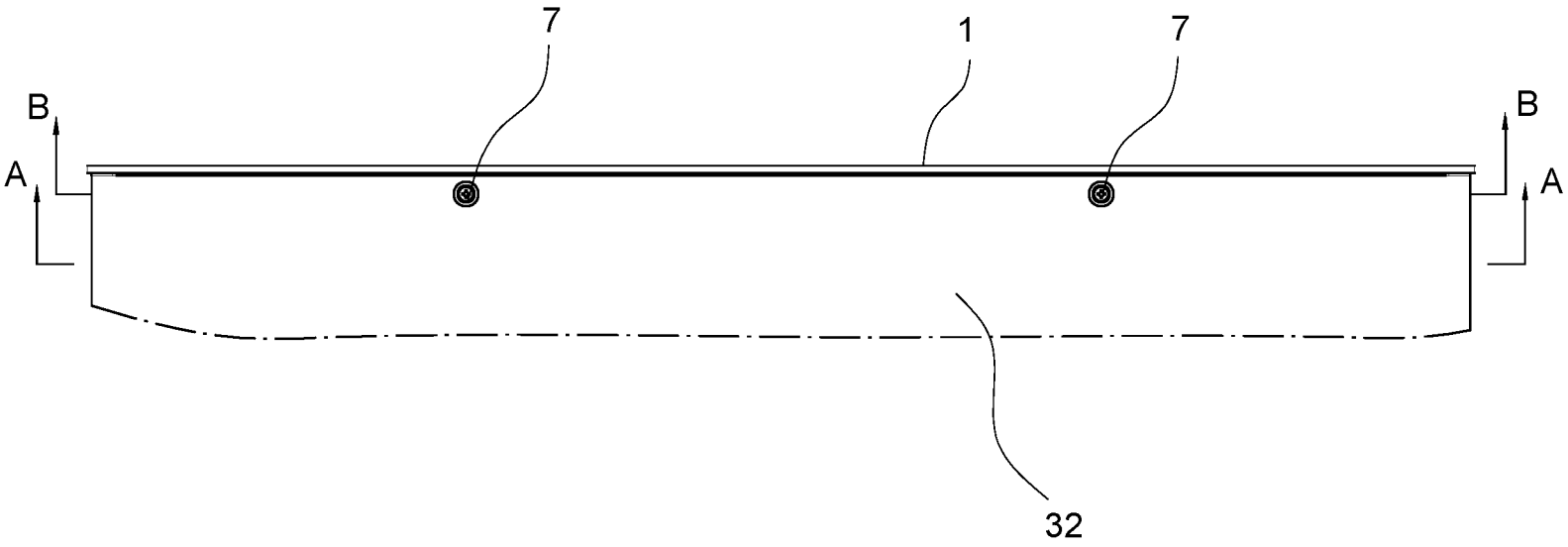
FIG. 5 is a top view of the range hood (part of the housing is omitted)
Figure 6:
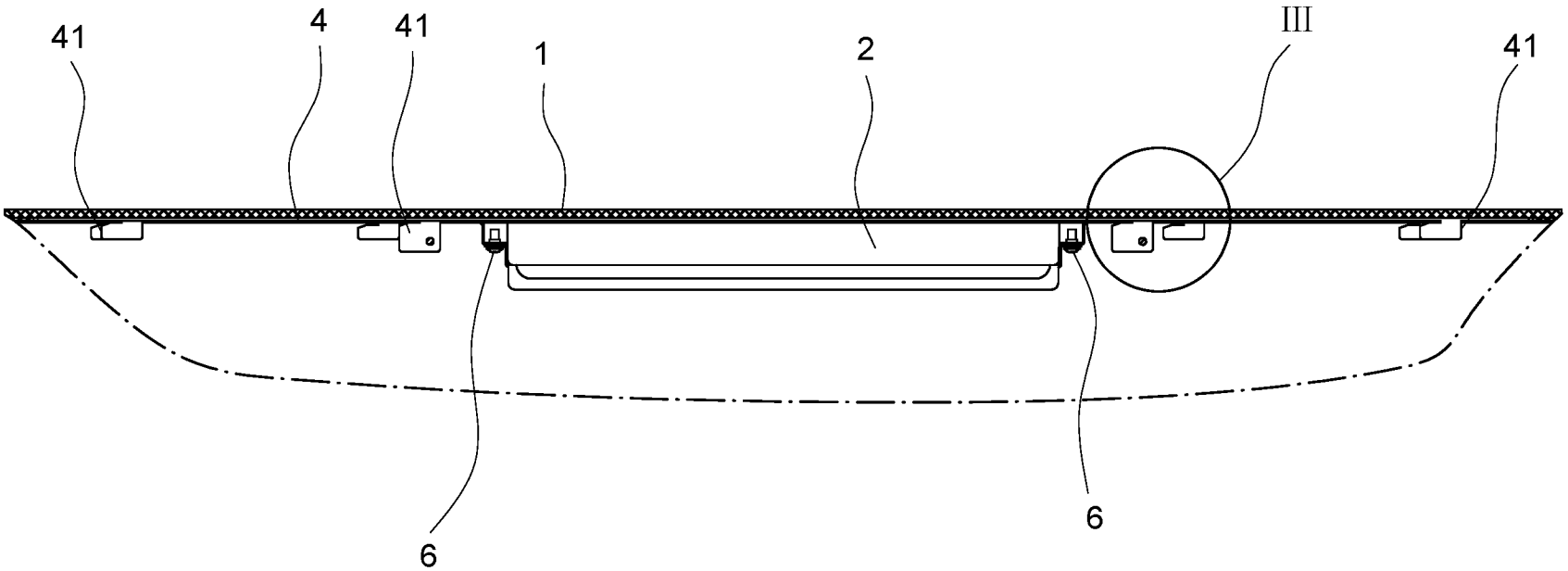
FIG. 6 is a sectional view of FIG. 5 in a direction A-A.
Figure 7:
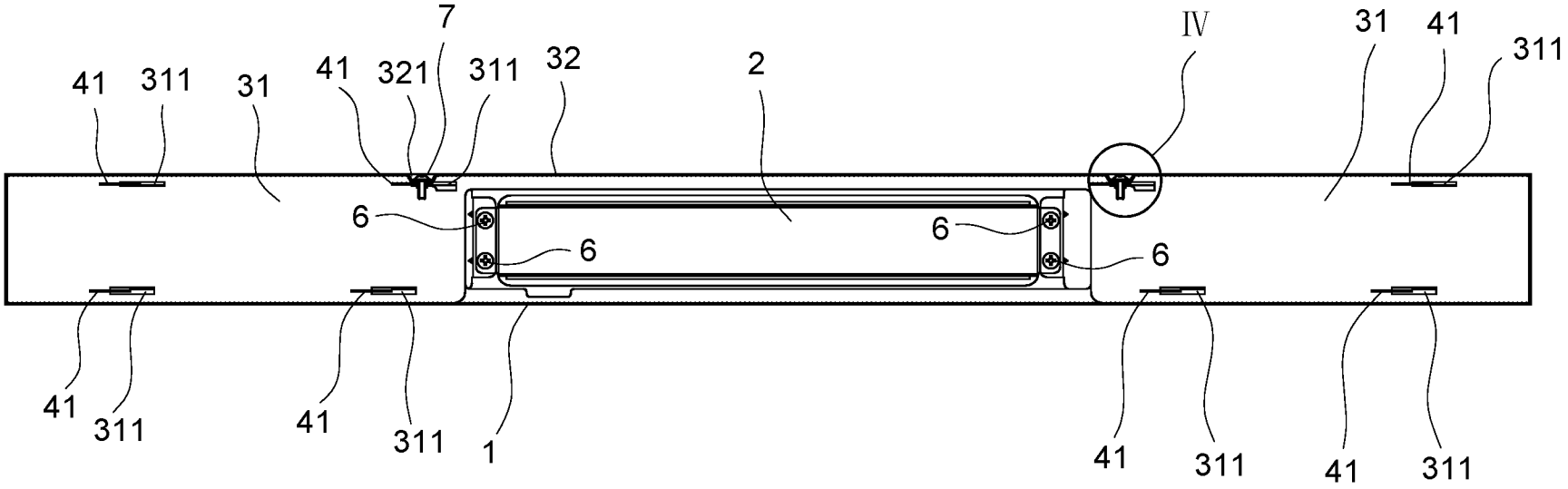
FIG. 7 is a sectional view of FIG. 5 in a direction B-B.
Figure 8:
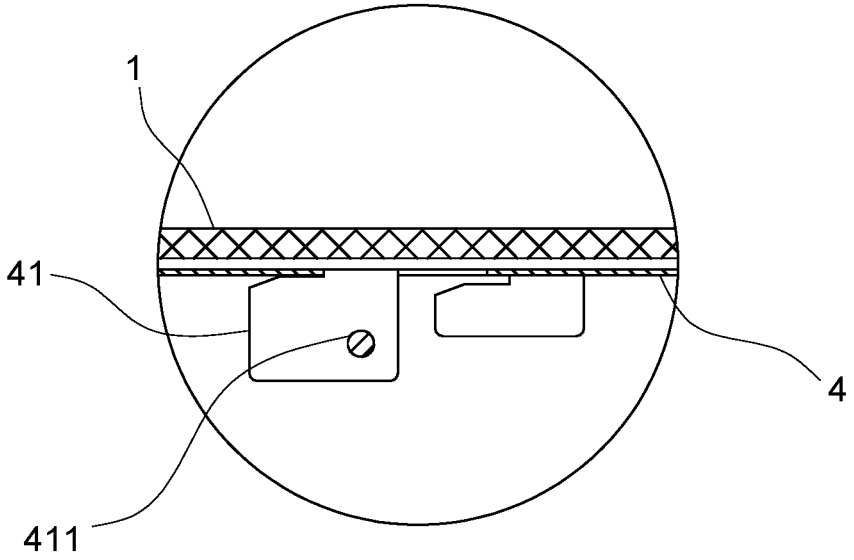
FIG. 8 is an enlarged view of a Part-III in FIG. 6.
Figure 9:
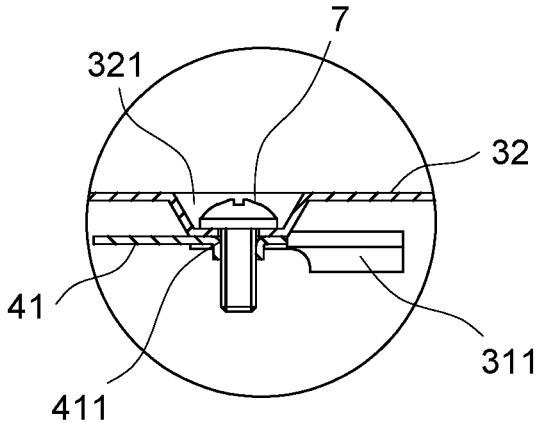
FIG. 9 is an enlarged view of a Part-IV in FIG. 7.
Figure 10:
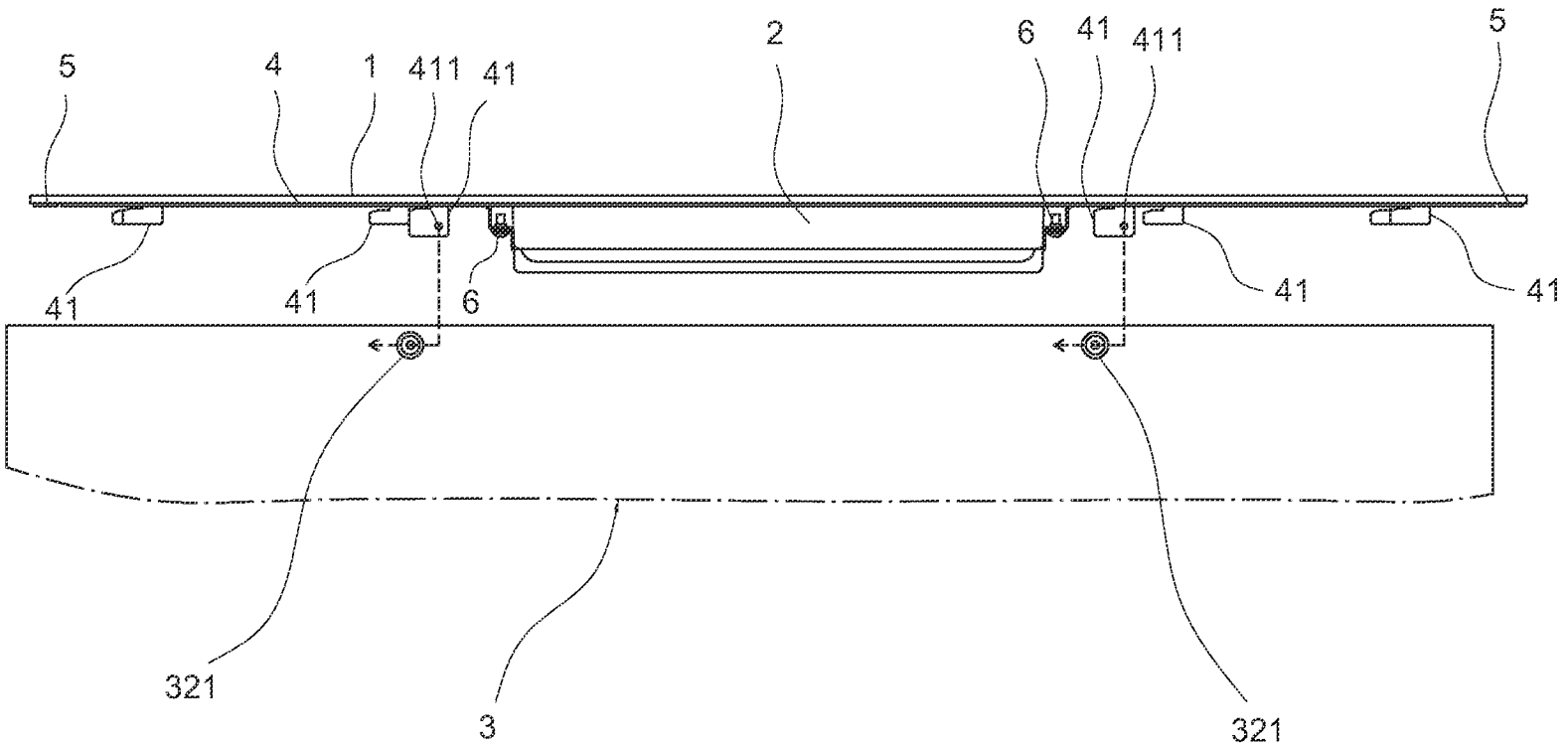
FIG. 10 shows an assembly manner of the control panel mechanism and the housing according to the embodiment of the present invention.
Figure 11:
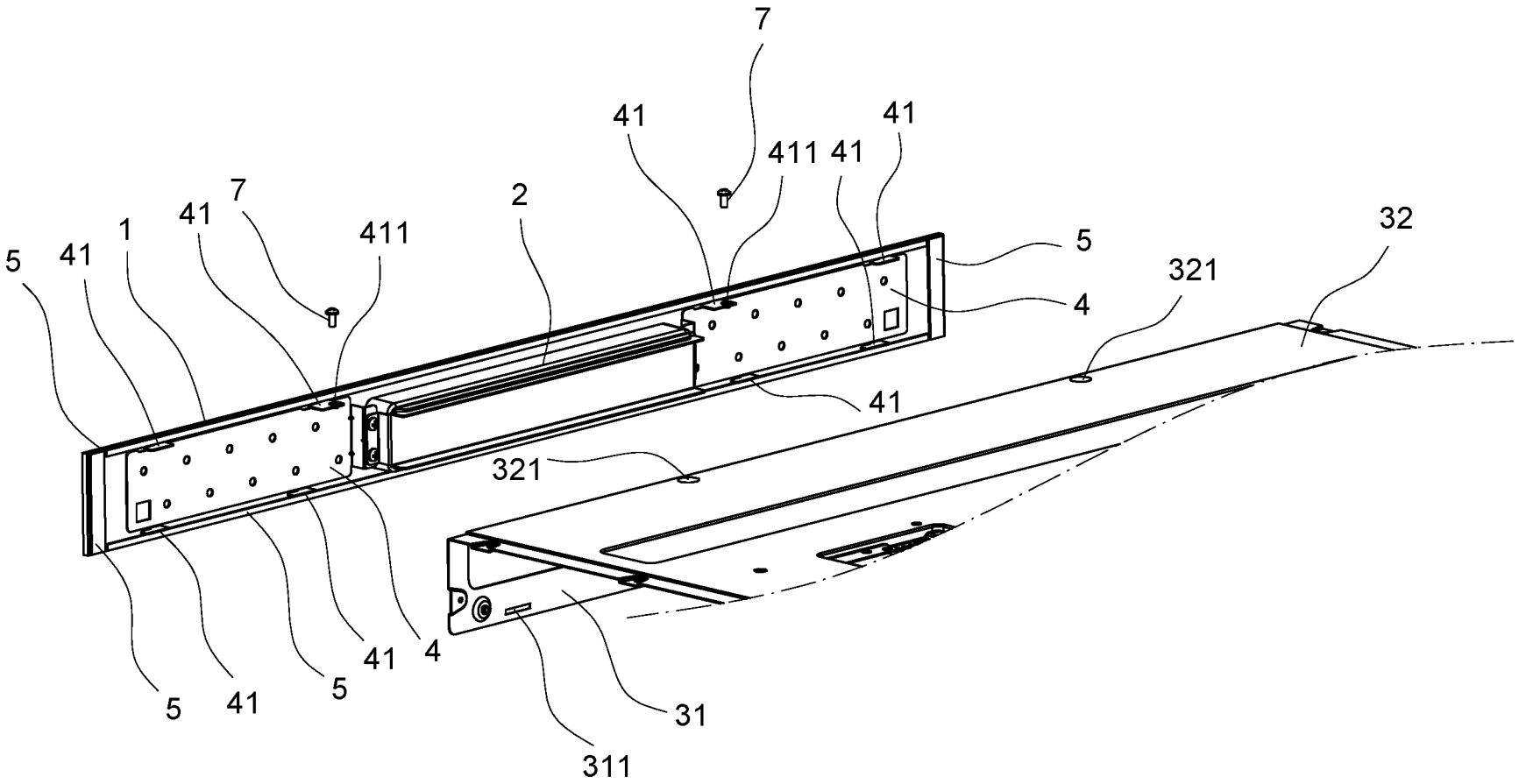
FIG. 11 is an exploded view of the control panel mechanism and the housing.
Figure 12:
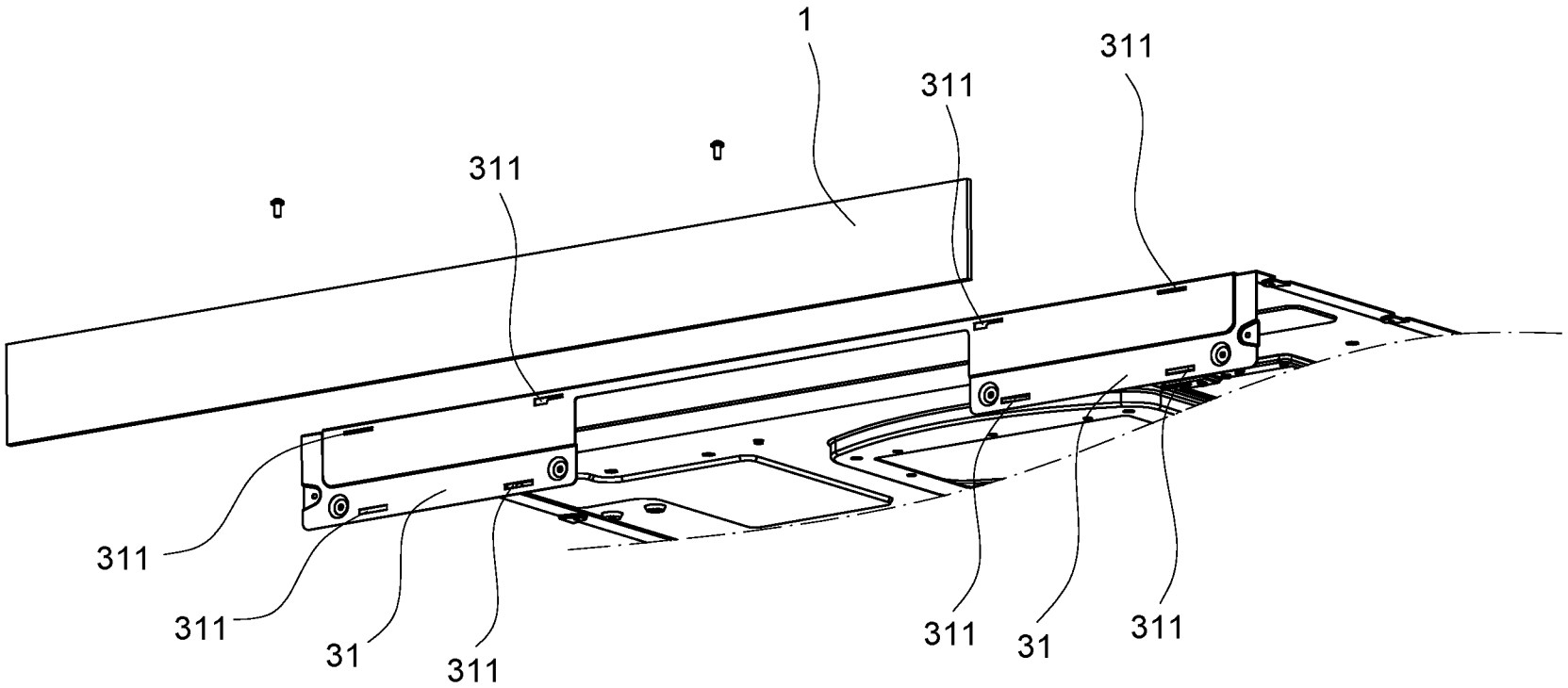
FIG. 12 is another perspective view of FIG. 11 from another view.

FIGS. 1 to 12 show a preferred embodiment of a control panel mechanism of a range hood according to the present invention. The range hood comprises a housing 2 with a plurality of front side plate 31 and a top plate 32; the control panel mechanism comprises a glass panel 1 and a control component 2.

The control component 2 is disposed at the middle of the back of the glass panel 1. Two mounting plates 4 are respectively disposed on left and right sides of the control component 2, and each mounting plate 4 matches with the glass panel 1 where it is located. Further, each mounting plate 4 is fixed to the back of the glass panel 1 by silicone adhesive, and each mounting plate 4 has a lug 42 formed on an inner end of each mounting plate 4 which is attached to left and right ends of the control component 2 by a plurality of first fasteners 6 (there are screws in this embodiment), respectively, so that the control component 2 is mounted on the back of the glass panel 1.

Further, an inserting piece 41 is disposed at each of four corners of each mounting plate 4 and extends horizontally backward relative to the glass panel 1. The housing 3 has left and right front side plates 31 on a front side of the housing 3 of the range hood, a space for embedding the control component 2 is formed between the front side plates 31. Each front side plate 31 is opposite to the corresponding mounting plate 4, and the front side plate 31 has a plurality of inserting hole 311 at corresponding positions for receiving the inserting piece 41 respectively. In this way, when the inserting piece 41 is inserted into the corresponding inserting hole 311, the control panel mechanism can be detachably connected to the housing 3. Preferably, to make the detachable connection between the control panel mechanism and the housing 3 more stable, free ends of the inserting pieces 41 on any one of the mounting plates 4 extend all toward left or toward right to form L-shaped inserting pieces 41. In this embodiment, the inserting piece 41 on both mounting plates 4 are bent horizontally to the right. When assembled in this way, the control panel mechanism is first dislocated in close proximity to the front side plates 31 of the housing 3 for receiving the inserting piece 41 into the corresponding inserting hole 311, and then returned to a normal position so as to fasten the bent portion of each inserting piece 41 on one side of the inserting hole 311, thereby limiting the inserting piece 41 in the corresponding inserting hole 311, so that a relatively stable and detachable connection can be realized between the control panel mechanism and the housing 3.

Further, inserting piece 41 has a first mounting hole 411 at an inner upper portion of each mounting plate 4, and the top plate 32 of the housing 3 has a second mounting hole 321 corresponding to the first mounting hole 411, and the second fastener 7 (in this embodiment, the second fasteners 7 are screws) passing through the first mounting hole 411 and the second mounting hole 321 attaching the inserting piece 41 to the top plate 32. Preferably, the second mounting hole 321 is designed with an annular step below the surface of the top plate 32, the second fastener 7 is located on the annular step and below the surface of the top plate 32, and the head of the second fastener 7 is located in the second mounting hole 321. By designing the second mounting hole 321 with an annular step below the surface of the top plate 32, the mounting position of the second fastener 7 is not directly visible, which can make the appearance of the range hood elegant.

In addition, a plurality of filler strips 5 surrounding the control component 2 and the mounting plate 4, and abutting against the front surface of the front side plate 31 of the housing 3, are disposed on the back of the glass panel 1 along the circumferential direction, thus avoiding the damage to the glass panel 1 caused by hard contact with the housing 3 during transportation or operating vibration.

In summary, in the present invention, a plurality of mounting plates 4 each having two ends are disposed on the back of the glass panel 1, one end of each mounting plate 4 is connected to the control component 2 by a plurality of first fasteners 6; the mounting plates 4 are detachably connected to the front side plate 31 of the housing 3 of the range hood, and the mounting plates 4 is attached to the top plate 32 of the housing 3 by the second fastener 7. When it is necessary to repair or replace the control component 2, the control component 2 can be removed from the glass panel 1 by unscrewing the first fasteners 6 after the control panel mechanism is removed from the housing 3 of the range hood by unscrewing the second fasteners 7, so that it is very convenient to assemble and disassemble the control component 2.

The invention claimed is:

1. A control panel mechanism of a range hood, comprising a glass panel (1) and a control component (2);

wherein, a plurality of mounting plates (4) each having two ends is disposed on a back of the glass panel (1), one of the two ends of each mounting plate (4) is connected to the control component (2) by a plurality of first fasteners (6);

the plurality of mounting plates (4) is detachably connected to a front side plate (31) of a housing (3) of the range hood, and the plurality of mounting plates (4) is attached to a top plate (32) of the housing (3) by a second fastener (7).

2. The control panel mechanism of claim 1, wherein each mounting plate (4) has at least one inserting piece (41) extending backward relative to the glass panel (1), and the front side plate (31) has a plurality of inserting holes (311) for receiving the at least one inserting piece (41);

the at least one inserting piece (41) has a first mounting hole (411), and the top plate (32) has a second mounting hole (321) corresponding to the first mounting hole (411), and the second fastener (7) passing through the first mounting hole (411) and the second mounting hole (321) attaching the at least one inserting piece (41) to the top plate (32).

3. The control panel mechanism of claim 2, wherein a free end of each inserting piece (41) extends towards the same direction.

4. The control panel mechanism of claim 2, wherein the second mounting hole (321) is designed with an annular step below a top surface of the top plate (32).

5. The control panel mechanism of claim 1, wherein a first mounting plate of the plurality of mounting plates (4) is disposed on the left side of the glass panel (1) and a second mounting plate of the plurality of mounting plates (4) is disposed on the right side of the glass panel (1).

6. The control panel mechanism of claim 1, wherein a plurality of filler strips (5) surrounding the control component (2) and the mounting plate (4), and abutting against a front surface of the front side plate (31) of the housing (3), are disposed on the back of the glass panel (1) along a circumferential direction.

* * * * *